US012256817B2

(12) United States Patent
Fraser

(10) Patent No.: US 12,256,817 B2
(45) Date of Patent: Mar. 25, 2025

(54) PORTABLE SHELTER

(71) Applicant: Mark Andrew Fraser, Hamilton (AU)

(72) Inventor: Mark Andrew Fraser, Hamilton (AU)

( * ) Notice: Subject to any disclaimer, the term of this patent is extended or adjusted under 35 U.S.C. 154(b) by 110 days.

(21) Appl. No.: 17/748,344

(22) Filed: May 19, 2022

(65) Prior Publication Data

US 2023/0058654 A1 Feb. 23, 2023
US 2024/0183186 A9 Jun. 6, 2024

Related U.S. Application Data

(63) Continuation-in-part of application No. 17/424,286, filed on Jul. 20, 2021, now Pat. No. 11,980,263.

(30) Foreign Application Priority Data

Aug. 19, 2021 (AU) ..... 2021105969
Aug. 25, 2021 (AU) ..... 2021221687

(51) Int. Cl.

*A45B 19/10* (2006.01)
*A45B 23/00* (2006.01)
*A45B 25/02* (2006.01)
*E04H 15/48* (2006.01)
*E04H 15/38* (2006.01)

(52) U.S. Cl.

CPC ..... *A45B 19/10* (2013.01); *A45B 25/02* (2013.01); *E04H 15/48* (2013.01); *A45B 2023/0012* (2013.01); *E04H 15/38* (2013.01)

(58) Field of Classification Search

CPC ..... A45B 19/10
See application file for complete search history.

(56) References Cited

U.S. PATENT DOCUMENTS 508,717 A * 11/1893 Hunt ..... A45B 19/10 135/25.32
805,957 A * 11/1905 Hoffman ..... A45B 19/10 135/25.31
954,357 A * 4/1910 Susemihl ..... A45B 19/10 135/25.4
1,908,453 A * 5/1933 Henry ..... A45B 19/10 135/22
3,732,882 A * 5/1973 Kida ..... A45B 19/10 135/25.33

(Continued)

FOREIGN PATENT DOCUMENTS

AU 2020100586 A4 5/2020
WO WO-2020150773 A1 * 7/2020 ..... A45B 19/10
WO 2021040863 A1 3/2021

*Primary Examiner* — David R Dunn
*Assistant Examiner* — Danielle Jackson
(74) *Attorney, Agent, or Firm* — Kelly M. Nowak; DeLio Peterson & Curcio LLC

(57) ABSTRACT

An embodiment of the present invention relates to a portable shelter, whether being of the type having a floating canopy or an umbrella. The shelter includes a support including an upright. A canopy is supported by the support. The canopy includes an expandable frame, and a sheet of material supported by the frame. The frame includes retractable ribs supporting the sheet. The frame also includes a stretcher arrangement for stretching out each rib from the support. The stretcher arrangement includes a first stretcher for coupling between the support and the rib; and a second stretcher for coupling to the first stretcher.

13 Claims, 11 Drawing Sheets

(56) References Cited

U.S. PATENT DOCUMENTS

| | | | | | |
|---|---|---|---|---|---|
| 3,902,514 | A * | 9/1975 | Weber | A45B 19/10 | 135/25.33 |
| 4,007,753 | A * | 2/1977 | DeMarco | A45B 19/10 | 135/25.33 |
| 4,131,122 | A * | 12/1978 | Brooks | A45B 9/02 | 135/79 |
| 4,674,524 | A * | 6/1987 | DeMarco | A45B 19/10 | 135/26 |
| 4,766,917 | A * | 8/1988 | Yang | A45B 25/16 | 135/25.3 |
| 4,984,599 | A * | 1/1991 | Hwang | A45B 19/10 | 135/26 |
| 5,909,746 | A * | 6/1999 | Doster | A45B 19/10 | 135/25.1 |
| 6,588,439 | B2 * | 7/2003 | Wu | A45B 19/10 | 135/31 |
| 8,079,378 | B1 | 12/2011 | Derlinga | | |
| D945,019 | S * | 3/2022 | Fraser | E04H 15/405 | D21/837 |
| 2002/0185167 | A1 * | 12/2002 | Lin | A45B 25/22 | 135/48 |
| 2005/0279391 | A1 * | 12/2005 | Brooks, III | E04H 12/2223 | 135/16 |
| 2010/0192997 | A1 | 8/2010 | Liu | | |
| 2019/0218814 | A1 * | 7/2019 | Fraser | E04H 15/003 | |
| 2019/0338549 | A1 | 11/2019 | McDermott | | |
| 2022/0087376 | A1 * | 3/2022 | Fraser | E04H 15/58 | |

* cited by examiner

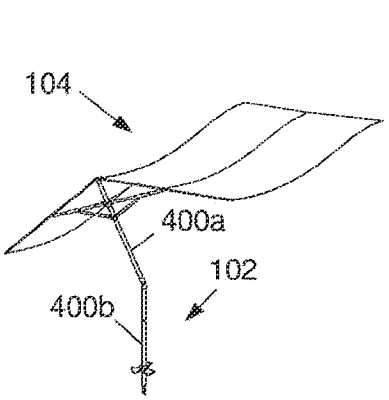
FIG. 3A
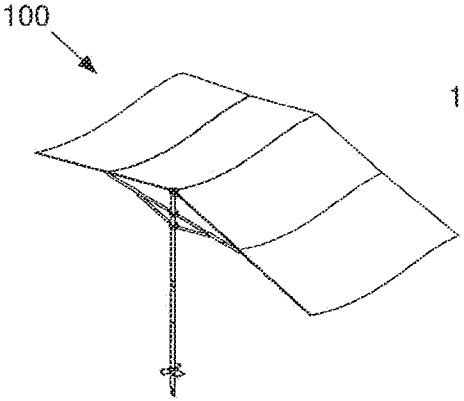
FIG. 3B
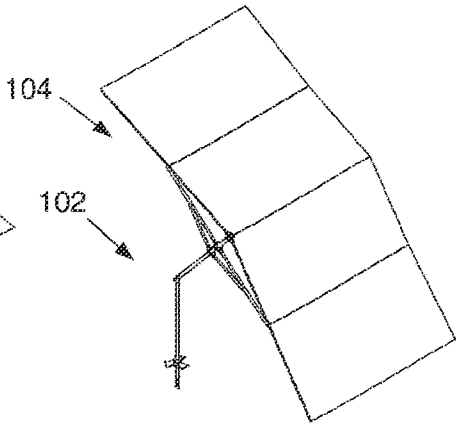
FIG. 3C
FIG. 4A
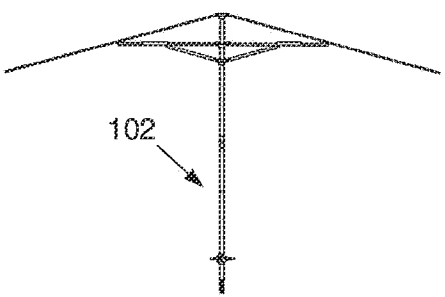
FIG. 4B
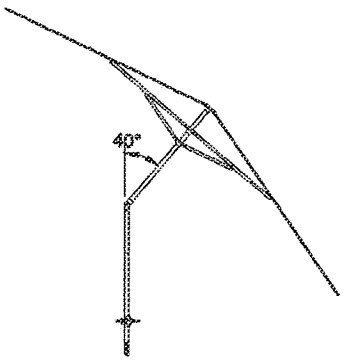
FIG. 4C

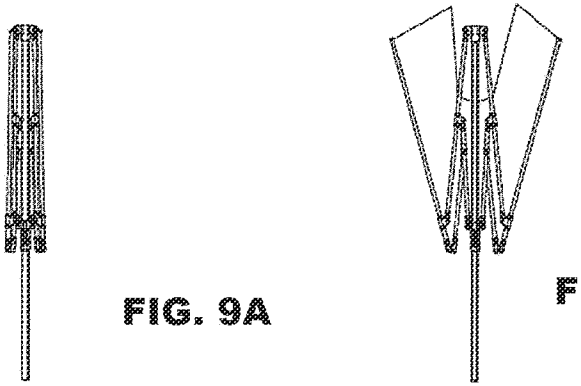
FIG. 9A
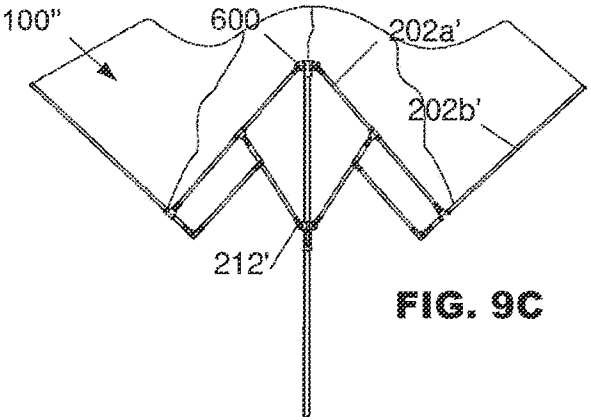
FIG. 9B
FIG. 9C
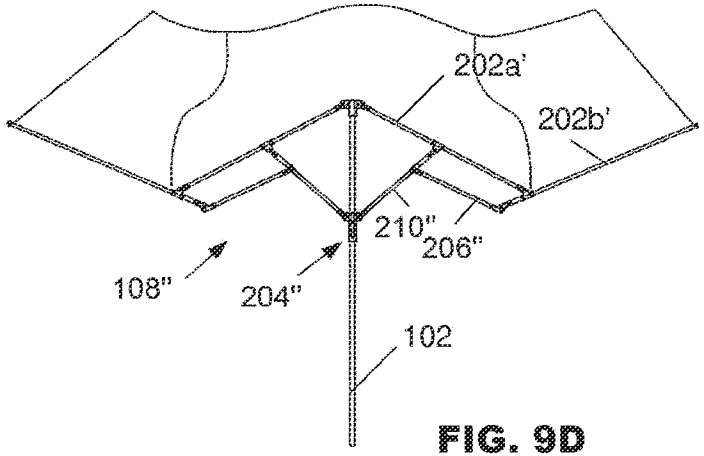
FIG. 9D
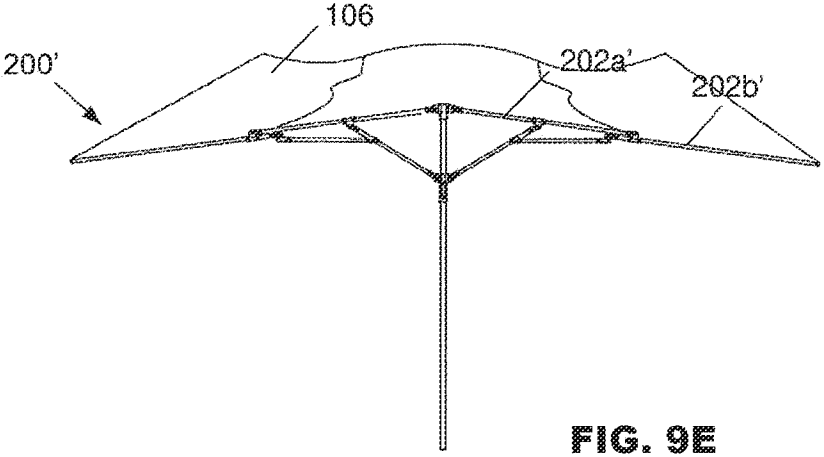
FIG. 9E

PORTABLE SHELTER

TECHNICAL FIELD

The present invention relates to a portable shelter. The present invention has particular, although not exclusive application to beach shelters and other like outdoor shelters.

BACKGROUND

The reference to any prior art in this specification is not, and should not be taken as an acknowledgement or any form of suggestion that the prior art forms part of the common general knowledge.

AU 2020100586 discloses a beach shelter suitable for windy conditions. The portable shelter includes a bridged frame, and a canopy including a fixed-end extending from the frame. A free-end of the canopy flutters freely in the breeze.

In practice, the bridged frame can be time-consuming and involved to assemble and/or relocate. The preferred embodiment provides for improved assembly and/or relocation of the shelter.

Further, in the event that the sun position or wind changes, the bridged frame is difficult to reconfigure to obtain desired shading from the shelter. The preferred embodiment provides for improved reconfiguration.

SUMMARY OF THE INVENTION

According to one aspect of the present invention, there is provided a portable shelter including:

a support including an upright; and a canopy for being supported by the support.

The canopy may include a free-end for fluttering in the breeze. The support may extend from the ground at a single location which may advantageously result in: improved assembly, and/or relocation of the shelter by simply moving the support to another single location. Alternatively, the shelter may be a hand-held umbrella with a secured canopy.

The support may be bent so that the canopy can be readily angled, without moving the support from the single location, to obtain desired shading from the shelter in the event that the sun position changes. The support may include a pair of hingedly coupled post members. The support may also be rotated about its axis in the ground. The canopy may be angled in a plane, up to 40° in either direction from vertical.

The canopy may include an expandable frame, and a sheet of material supported by the frame. The sheet may fold in on itself when the frame is collapsed. The sheet may be permanently affixed to the frame. The frame may expand in a single plane. The frame may include the support.

The frame may include retractable ribs supporting the sheet. Each rib may be articulated. Each rib may be pivotally expandable. Each rib may include a proximal member, and a distal member pivotally coupled to the proximal member. The proximal member may not be coupled to the end of the distal member. An end of the distal member may be pivotally coupled to a stretcher arrangement. The distal member may fold in toward the proximal member. The frame may include two or four ribs.

The frame may include a stretcher arrangement for stretching out each rib from the support. The stretcher arrangement may include two or more stretchers, and preferably three stretchers. The stretchers may converge when stretching out the rib. The stretcher arrangement may include a first stretcher coupled between the support and the rib. The stretcher arrangement may include a slider for sliding along the first stretcher. A second stretcher may be coupled to the slider. The stretcher arrangement may further include a second stretcher coupled between the first stretcher and a runner for running along the support. The second stretcher may be slidably attached to the first stretcher. The stretcher arrangement may further include a third stretcher coupled between the first stretcher and the support. The third stretcher may be slidably attached to the first stretcher. The third stretcher may be pivotally coupled to the second stretcher.

The runner may move upward to expand the ribs. The shelter may include a lock for locking the expanded frame. The lock may include a pin for being received in the support and for locking the runner in place. The shelter may include means for rotating the support to suit wind direction. The shelter may further include at least one foot protrusion for engaging with a foot to couple the support in the ground. The protrusion may be retractable. The shelter may include three spaced apart protrusions radially extending from the support. The support may terminate in a screw for screwing into the ground. The shelter may include a depth indicator to indicate that the support is of sufficient depth in the ground The shelter may further include a tether for tethering to the support, and an anchor for anchoring the tether. The anchor may include a receptacle for receiving earth.

According to another aspect of the present invention, there is provided a method for erecting a shelter including:

erecting a support including an upright post extending from the ground; and supporting, using the support, a canopy so that its free-end flutters in the breeze.

According to another aspect of the present invention, there is provided an expandable frame for a portable shelter, the frame including:

one or more retractable ribs for supporting sheet material; and a stretcher arrangement for stretching out the ribs from a support, the stretcher arrangement including:

a first stretcher for coupling between the support and the rib; and a second stretcher for coupling to the first stretcher.

According to another aspect of the present invention, there is provided an expandable frame for a portable shelter, the frame including one or more retractable ribs for supporting sheet material, each rib including:

a proximal member; and a distal member pivotally coupled to the proximal member;

wherein the proximal member is not coupled to the end of the distal member so there is overlap when the rib is fully expanded.

Any of the features described herein can be combined in any combination with any one or more of the other features described herein within the scope of the invention.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows:

FIG. 3A is an upper perspective view showing the angling of the canopy of the portable shelter in accordance with an embodiment of the present invention;

FIG. 3B is an upper perspective view showing a different angling configuration of the canopy of the portable shelter in FIG. 3A;

FIG. 3C is an upper perspective view showing a different angling configuration of the canopy of the portable shelter in FIG. 3A;

FIG. 4A is a front view of the portable shelter depicted in 3A;

FIG. 4B is a front view of the portable shelter depicted in 3B;

FIG. 4C is a front view depicting the portable shelter in 30;

FIG. 51 is a magnified perspective view of detail portion A in FIG. 5G;

FIG. 9A is a front view depicting the frame configuration of a portable shelter in accordance with another embodiment of the present invention;

FIG. 9B is a front view of the frame configuration of FIG. 9A during a subsequent assembly position;

FIG. 9C is a front view of the frame configuration of FIG. 9B during a subsequent assembly position;

FIG. 9D is a front view of the frame configuration of FIG. 9C during a subsequent assembly position;

FIG. 9E is a front view of the frame configuration of FIG. 9D during a subsequent assembly position;

DETAILED DESCRIPTION OF PREFERRED EMBODIMENTS

Figure 1A:
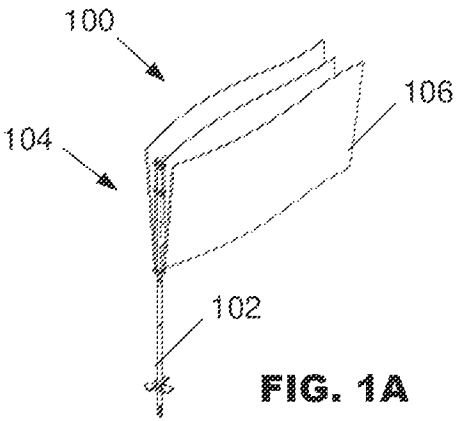
FIG. 1A is an upper perspective view of a portable shelter during sequential assembly in accordance with an embodiment of the present invention.
Figure 1B:
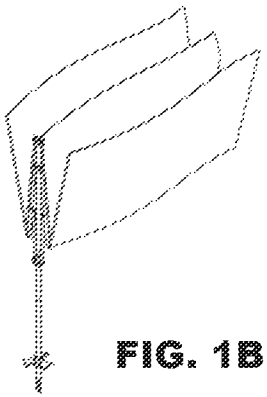
FIG. 1B is an upper perspective view during a subsequent assembly position of the portable shelter depicted in FIG. 1A.
Figure 1C:
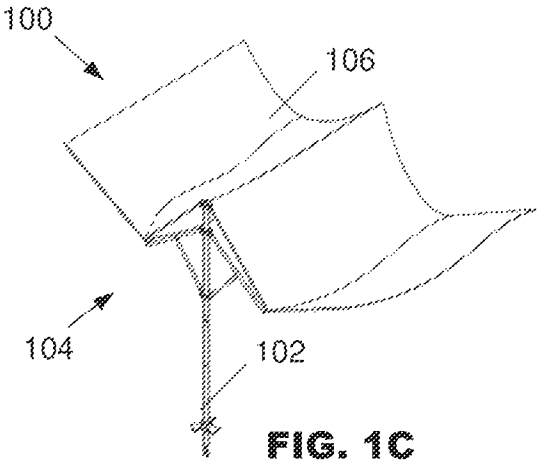
FIG. 1C is an upper perspective view during a subsequent assembly position of the portable shelter depicted in FIG. 1B.
Figure 1D:
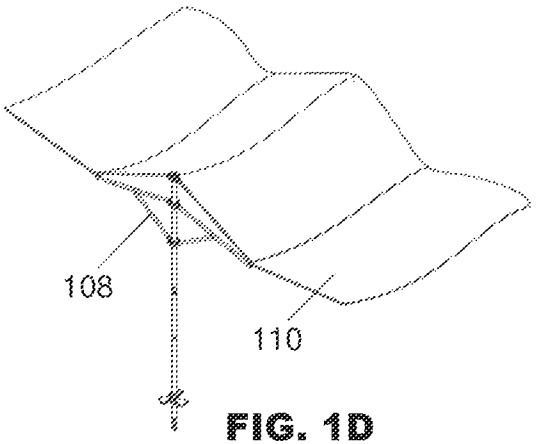
FIG. 1D is an upper perspective view during a subsequent assembly position of the portable shelter depicted in FIG. 1C.
Figure 1E:
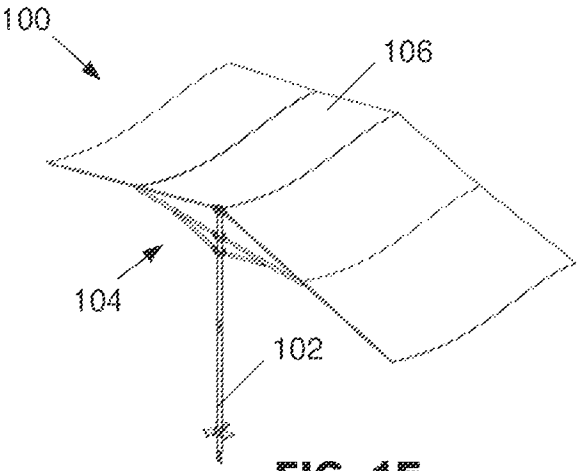
FIG. 1E is an upper perspective view during a subsequent assembly position of the portable shelter depicted in FIG. 1D.

According to an embodiment of the present invention, there is provided a portable shelter 100 as shown in FIG. 1. The shelter 100 has a support 102 including an upright post extending up from the ground at a single location. A collapsible canopy 104 is supported by the support 102 and includes a free-end 106 for fluttering in the breeze.

The support 102 extends from the ground at a single location which advantageously results in improved assembly with ready erection of the sole support 102. Further, the shelter 100 can be readily relocated by simply moving the support 102 to another single location.

The canopy 104, forming a roof, includes an expandable frame 108, in turn, including the upper end of the support 102. Further, the canopy 104 includes a sheet 110 of flaccid material at a fixed end which extends from the frame 108 to its fluttering free end 106 opposite the fixed end. The sheet 110 is permanently affixed to the frame 108, and is expanded in-situ as the frame 108 expands in a single plane during shelter assembly, without the need for separate fastening of the sheet 110 which would otherwise be time-consuming. The majority of the sheet 110 is not supported and flutters in the breeze to provide suitable shade from the canopy for at least one person.

Figure 1F:
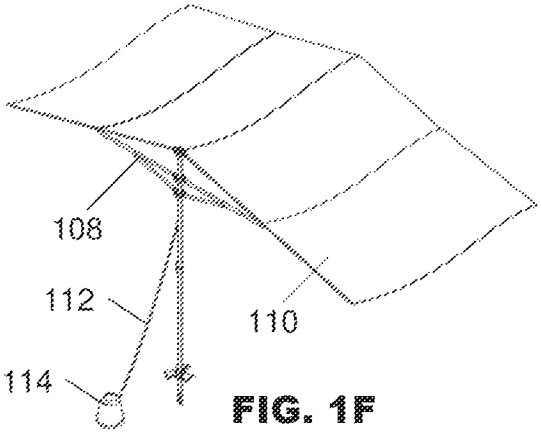
FIG. 1F is an upper perspective view during a subsequent assembly position of the portable shelter depicted in FIG. 1E.

As can best be seen in FIG. 1F, the shelter 100 further includes a tether 112 for tethering to the support 102, and an anchor 114 for anchoring the tether 112. The anchor 114 includes a receptacle for receiving surrounding earth, such as sand and rock.

Figure 2C:
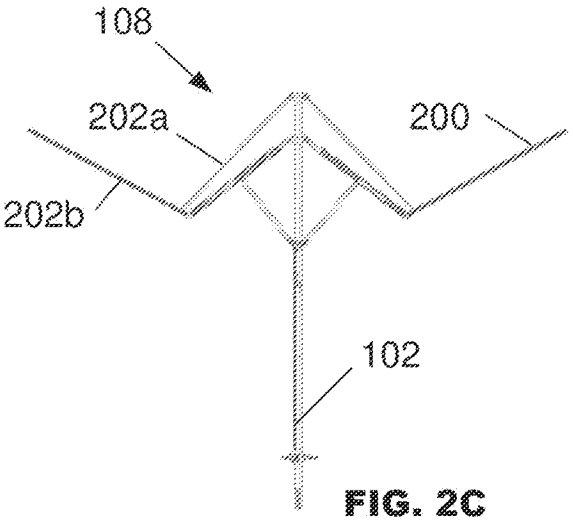
FIG. 2C is a front view during a subsequent assembly position of the frame configuration of the portable shelter depicted in FIG. 2B.

As can best be seen in FIG. 2C, the frame 108 includes an opposed pair of uppermost articulated ribs 200, retractable on either side of the support 102, for supporting the sheet 110. The sheet 110 folds in on itself when the frame 108 is collapsed so that the wet surfaces fold together and any water is contained there-between. Each rib 200 is pivotally expandable from the support 102 in two different directions, namely including a pair of pivotally joined rib members, with one rib member 202*a* pivoting in a clockwise direction and the other rib member 202*b* pivoting in an anticlockwise direction. The weight of the sheet 110 on the distal members 202*b* biases the ribs 200 toward an expanded configuration.

Figure 2E:
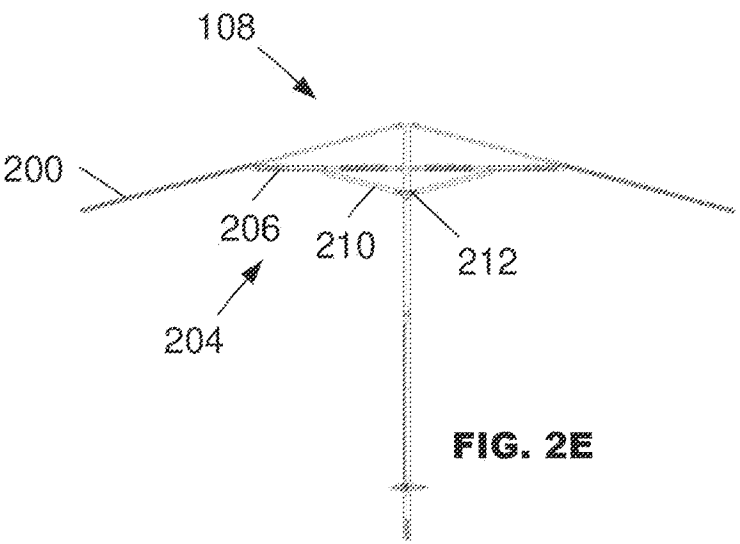
FIG. 2E is a front view during a subsequent assembly position of the frame configuration of the portable shelter depicted in FIG. 2D.
Figure 2B:
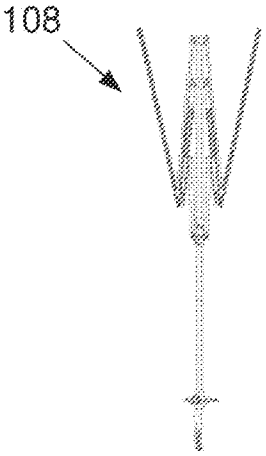
FIG. 2B is a front view during a subsequent assembly position of the frame configuration of the portable shelter depicted in FIG. 2A.
Figure 2D:
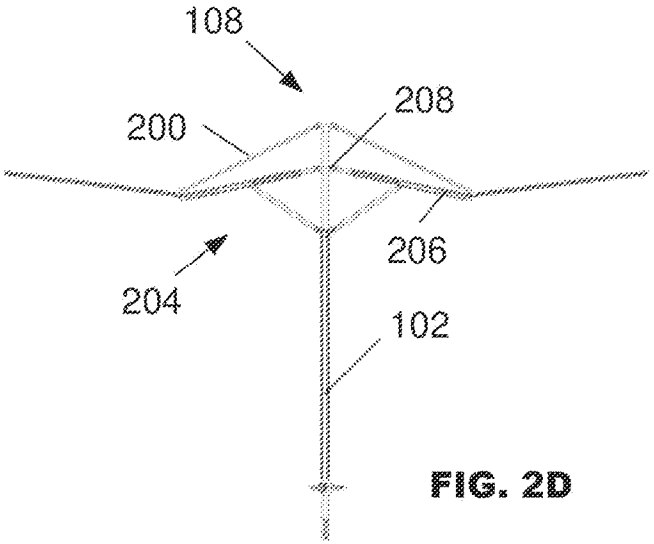
FIG. 2D is a front view during a subsequent assembly position of the frame configuration of the portable shelter depicted in FIG. 2C.
Figure 2A:
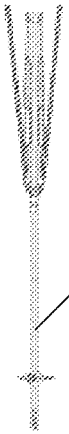
FIG. 2A is a front view showing the frame configuration of the portable shelter in FIGS. 1A-1F during the sequential assembly.

As can best be seen in FIG. 2D, the frame 108 also includes a stretcher arrangement 204 for expanding the ribs 200 from the support 102. The stretcher arrangement 204 includes a pair of upper stretchers 206 pivotally coupled between an upper runner 208 for running along the support 102 and the ribs 200.

As can best be seen in FIG. 2E, the stretcher arrangement 204 further includes a pair of lower stretchers 210 pivotally coupled between the upper stretchers 206 and a lower runner 212. The runners 208, 212 move toward each other, along the support 102, to expand the ribs 200.

The shelter 100 includes a lock for locking the expanded frame 108. The lock includes an over-centering arrangement for locking the frame 108 in an expanded configuration when the runners 208, 212 are moved together beyond a certain point. The lock also includes a pin for being received in the support 102 and for locking at least one of the runners 208, 212 in place.

Turning to FIGS. 3 and 4, the support 102, being bendable, includes a pair of hingedly coupled post members 400*a*, 400*b* so that the canopy 104 can be readily angled, without moving the support 102 from the single location in the ground, to obtain desired shading from the shelter 100 in the event that the sun position changes. The support 102 can be rotated about its axis in the ground to accommodate changes in wind, and the expanded canopy 104 can be angled in a plane, up to about 40° in either direction from vertical.

Turning to FIGS. 5, the shelter 100 further includes three retractable foot platforms 500 (i.e. protrusions), extending transversely at the base of the support 102, for engaging with a foot to couple the support 102 in the ground. Each foot platform 500 includes a pair of hinged plates, with the top plate fixed in position along the support 102, and radially extending transverse the support 102. The support 102 also terminates in a screw tip 502 for screwing into the ground.

A method for erecting the shelter 100 is now described.

Figure 5A:
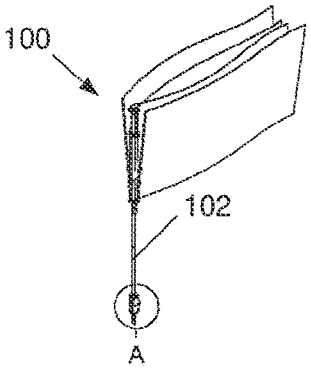
FIG. 5A is an upper perspective view of a retractable foot platform of an embodiment of the portable shelter of the present invention.
Figure 5B:
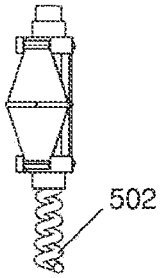
FIG. 5B is a magnified side view of detail portion A in FIG. 5A.
Figure 5C:
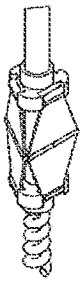
FIG. 5C is a magnified perspective view of detail portion A in FIG. 5A.
Figure 5D:
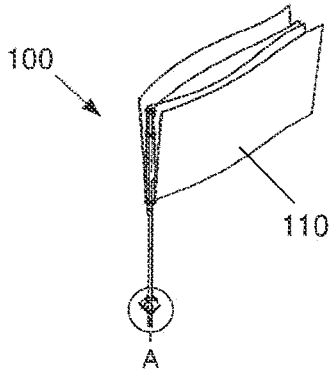
FIG. 5D is an upper perspective view of the portable shelter and retractable foot platform of FIG. 5A during a subsequent deployment step.
Figure 5E:
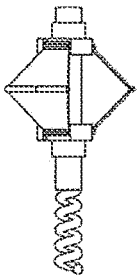
FIG. 5E is a magnified side view of detail portion A in FIG. 5D.
Figure 5F:
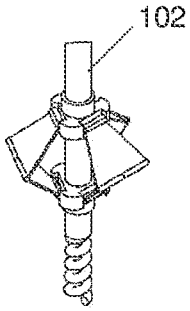
FIG. 5F is a magnified perspective view of detail portion A in FIG. 5D.
Figure 5G:
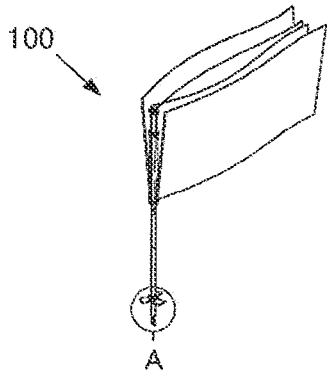
FIG. 5G is an upper perspective view of the portable shelter and retractable foot platform of FIG. 5D during a subsequent deployment step.
Figure 5H:
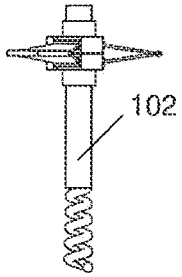
FIG. 5H is a magnified side view of detail portion A in FIG. 5G.
Figure 5I:
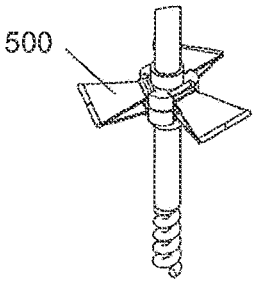

Initially as shown in FIGS. 5A to 5C, the support 102 is screwed into the ground which, in turn, pushes against and expands the foot platforms 500. A user can kick the edge of one of the partially expanded foot platforms 500, functioning as a lever, to further rotate and drive the support 102 into the ground, which hardens with depth, to align the folded sheet 110 into the wind. Meanwhile, the top end of the support 102 is held for stability. The fully expanded foot platforms 500 also serve as a dynamic depth indicator to expand and indicate that the support is of sufficient depth in the ground. The fully expanded foot platforms 500 are stabilizing protrusions for engaging with the adjacent ground surface in wind gusts and stabilizing the support 102 in the ground FIG. 1A shows the erected support 102 including the upright post extending from the ground in which it is screwed. The support 102 initially supports the retracted canopy 104 so that its free-end 106 flutters in the breeze.

As shown in FIGS. 1B to 1E, the runners 208, 212 (see also FIG. 2) are brought together by the user to expand the canopy 104. The lock locks the runners 208, 212 along the support 102.

As the day goes by, and the wind direction and sun position changes, the support 102 can be: rotated using the foot platforms 500 as shown in FIG. 5, and angled about the hinge as shown in FIG. 4, to maintain suitable shade from the canopy 104.

A similar shelter 100' according to another embodiment is shown in FIG. 6.

Figure 6C:
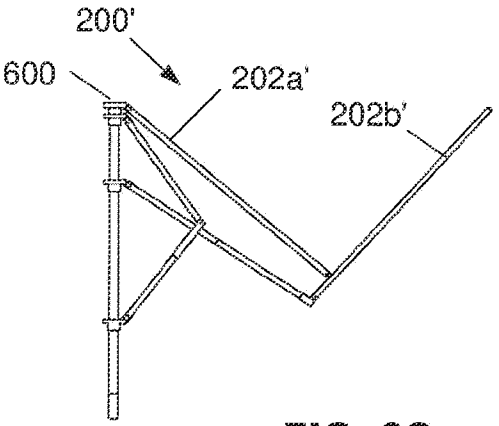
FIG. 6C is a front view of half the frame configuration of the portable shelter in FIG. 6B during a subsequent assembly position.
Figure 6E:
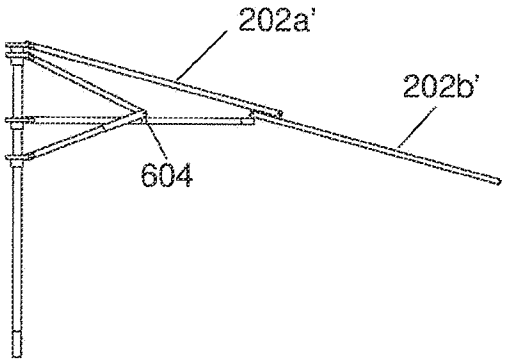
FIG. 6E is a front view of half the frame configuration of the portable shelter in FIG. 6F during a subsequent assembly position.
Figure 6B:
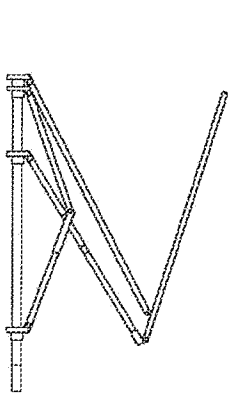
FIG. 6B is a front view of half the frame configuration of the portable shelter in FIG. 6A during a subsequent assembly position.
Figure 6A:
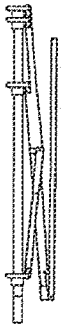
FIG. 6A is a front view showing half the frame configuration of a portable shelter in in accordance with another embodiment.

Turning first to FIG. 6C, the frame 108' includes retractable ribs 200' supporting the sheet 110, as before. Each uppermost rib 200' is articulated and pivotally expandable. Each rib 200' includes a proximal member 202*a*' pivotally coupled to the top of the support 102 at a fixed hub 600, and a distal member 202*b*' pivotally coupled to the proximal member 202*a*'. The proximal member 202*a*' is not coupled to the end of the distal member 202*b*' so there is overlap when the rib 200' is fully expanded (see. FIG. 6E), making it difficult for the shelter 100' to flip inside-out when windy and enabling the shelter 100' to fold down to half the length of a normal shelter. During collapse, the distal member 202*b*' folds in toward the proximal member 202*a*', as before. The frame 108', shown in a single plane, includes two ribs 200', although can be extended to be a dual-plane frame with four evenly spaced ribs 200' for an umbrella.

Figure 6D:
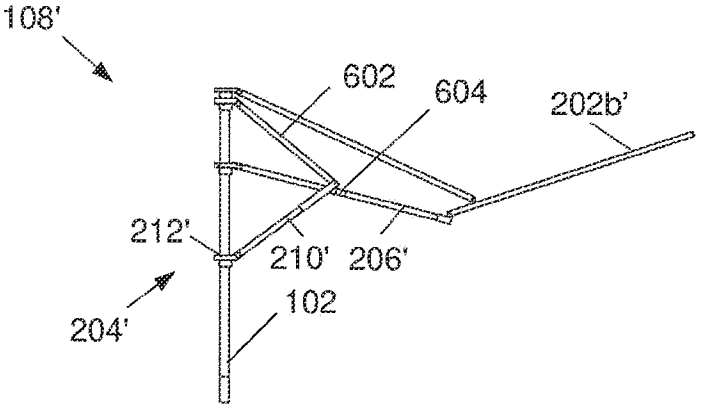
FIG. 6D is a front view of half the frame configuration of the portable shelter in FIG. 6C during a subsequent assembly position.

Turning to FIG. 6D, a proximal end of the distal member 202*b*' is pivotally coupled to a stretcher arrangement 204' of the frame 108'. The stretcher arrangement 204' stretches out each rib 200' from the support 102 using three fixed length stretchers 206', 210', 602.

An intermediate (i.e. first) stretcher 206' is pivotally coupled between the support 102, via a fixed hub 600, and the end of the distal member 202*b*' of the rib 200'.

A lower (i.e. second) stretcher 210' is coupled between the intermediate stretcher 206' and a sliding runner 212' for running along the support 102. The lower stretcher 210' is slidably attached to the intermediate stretcher 206', via a tubular slider 604 to which it is pivotally attached. Accordingly, the lower stretcher 210' is pivotally coupled to the slider 604 and the runner 212'.

An upper (i.e. third) stretcher is coupled between the intermediate stretcher 206' and the support 102. The upper stretcher 602 is also slidably attached to the intermediate stretcher 206', via a slider 604 to which it is pivotally attached. Accordingly, the upper stretcher 602 is pivotally coupled to the slider 604 and a fixed hub 600.

In use, the runner 212' is moved upward to expand the ribs 200' or downward to collapse them with an incredibly easy movement. In pushing the runner 212' up, the slider 604 slides out along the intermediate stretcher 206' and the ribs 200' expand. The upper and lower stretchers 210', 602 converge. The shelter 100' includes a lock for locking the expanded frame 108' with a locking pin in the runner 212' and support 102.

A similar shelter 100" according to another embodiment is shown in FIGS. 7 and 8.

Figure 8C:
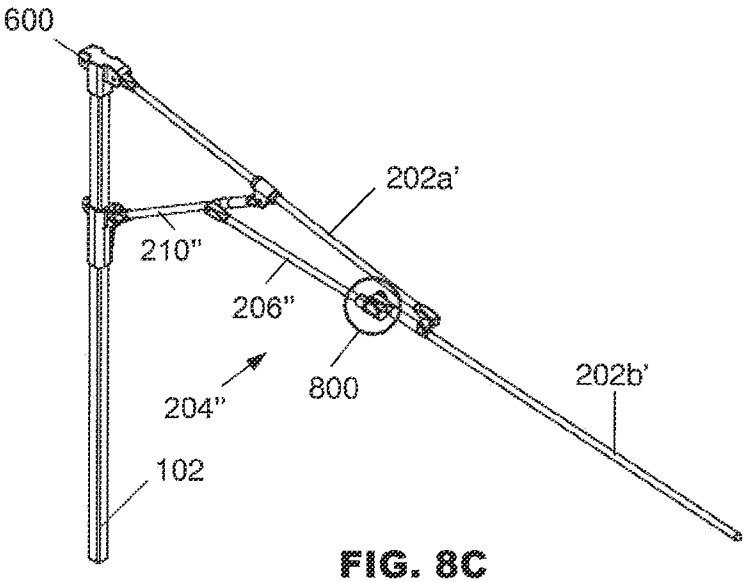
FIG. 8C is an upper perspective view of half the shelter of FIG. 7E.

Turning first to FIG. 8C, the frame 108" includes retractable ribs 200' supporting the sheet 110, as before. As before, each uppermost rib 200' is articulated and pivotally expandable. Each rib 200' includes a proximal member 202*a*' pivotally coupled to the top of the support 102 at a fixed hub 600, and a distal member 202*b*' pivotally coupled to the proximal member 202*a*'. The proximal member 202*a*' is not coupled to the end of the distal member 202*b*' so there is overlap when the rib 200' is fully expanded (see. FIG. 8E), making it difficult for the shelter 100" to flip inside-out when windy and enabling the shelter 100" to fold down to half the length of a normal shelter. During collapse, the distal member 202*b*' folds in toward the proximal member 202*a*', as before. The frame 108", shown in a single plane, includes two ribs 200', although can be extended to be a dual-plane frame with four evenly spaced ribs 200' for an umbrella.

Figure 7C:
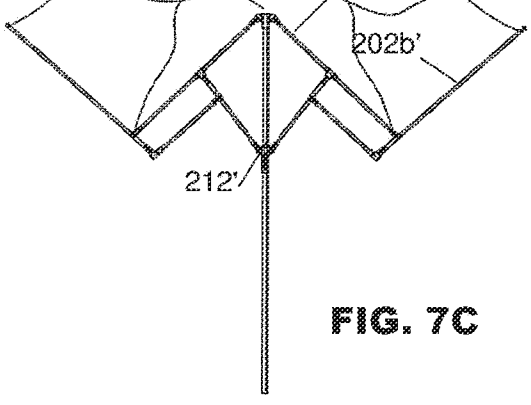
FIG. 7C is a front view of the portable shelter in FIG. 7B during a subsequent assembly position.
Figure 7B:
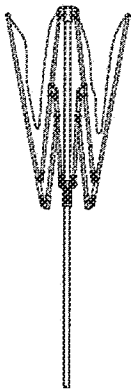
FIG. 7B is a front view of the portable shelter in FIG. 7A during a subsequent assembly position.
Figure 7A:
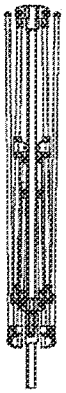
FIG. 7A is a front view depicting the frame configuration of a portable shelter in accordance with another embodiment.
Figure 7E:
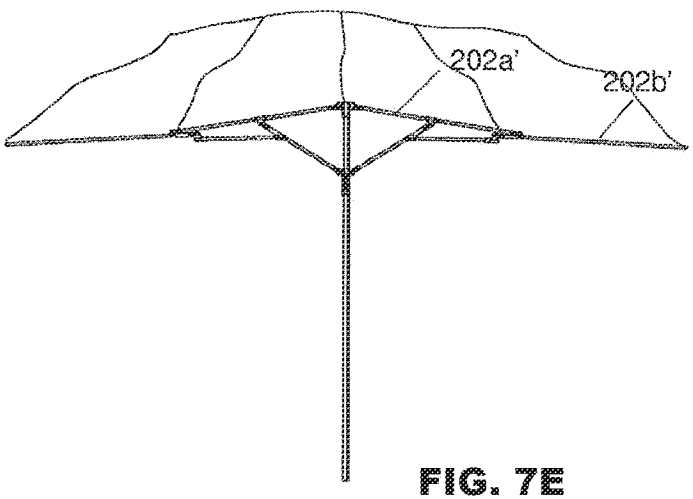
FIG. 7E is a front view of the portable shelter in FIG. 7D during a subsequent assembly position.
Figure 7D:
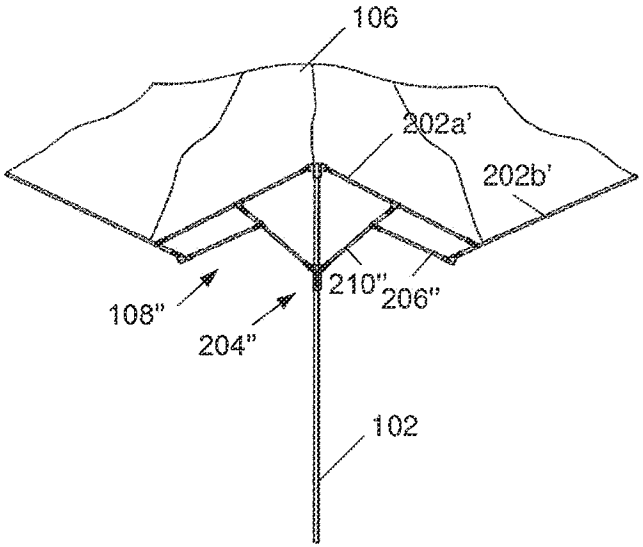
FIG. 7D is a front view of the portable shelter in FIG. 7C during a subsequent assembly position.

Turning to FIG. 7D, a proximal end of the distal member 202*b*' is pivotally coupled to a stretcher arrangement 204" of the frame 108". The stretcher arrangement 204" stretches out each rib 200' from the support 102 using two fixed length stretchers 206", 210", both pivotally mounted at both ends. The stretchers 206", 210" can be coupled together, as previously shown in FIG. 6 with a slider 604.

In use, the runner 212' is moved upward to expand the ribs 200' or downward to collapse them with an incredibly easy movement. In pushing the runner 212' up, the slider 604 the stretchers 206", 210" stretch out the ribs 200'.

Figure 8D:
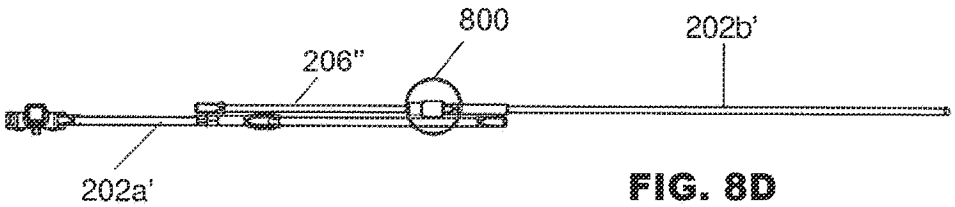
FIG. 8D is a top view of half the shelter of FIG. 8C.
Figure 8A:
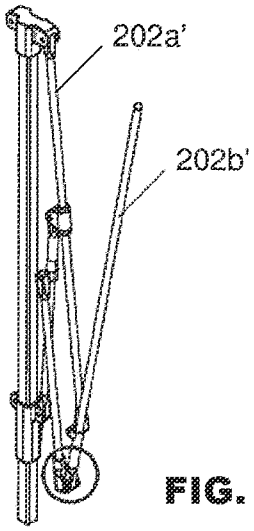
FIG. 8A is an upper perspective view of half the shelter of FIG. 7B.
Figure 8B:
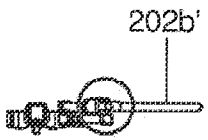
FIG. 8B is a top view of half the shelter of FIG. 8A.
Figure 10C:
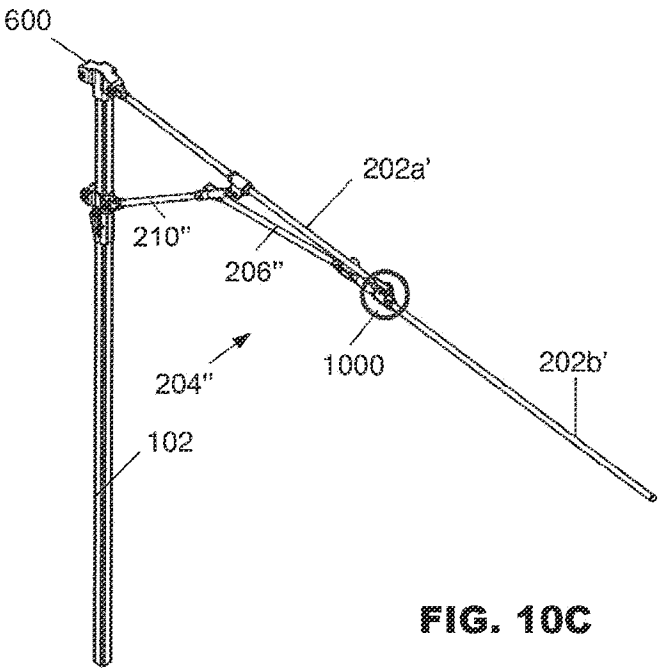
FIG. 10C is an upper perspective view of half the shelter of FIG. 9E.
Figure 10D:
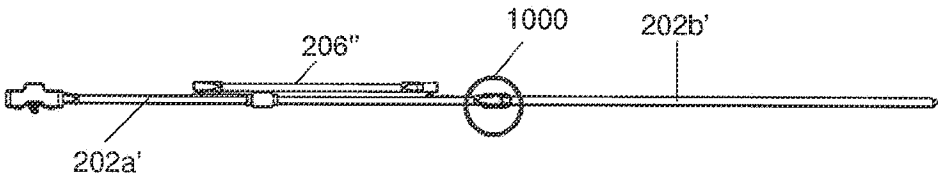
FIG. 10D is a top view of half the shelter of FIG. 10C.
Figure 10A:
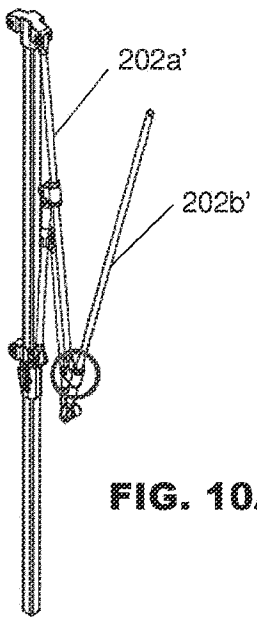
FIG. 10A is an upper perspective view of half the shelter of FIG. 9B.
Figure 10B:
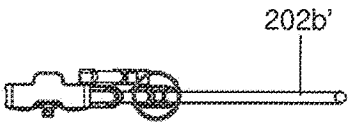
FIG. 10B is a top view of half the shelter of FIG. 10A.

As can best be seen in FIG. 8D, the proximal member 2frame 10802*a*' is coupled using coupler 800 to be adjacent to the distal member 202*b*' in a horizontal plane. Alternatively, in the similar embodiment shown in FIGS. 9 and 10, and as best be seen in FIG. 10D, the proximal member 202*a*' is coupled using coupler 1000 to be adjacent (or superimposed relative) to the distal member 202*b*' in a vertical plane.

A person skilled in the art will appreciate that many embodiments and variations can be made without departing from the ambit of the present invention.

In one embodiment, the runner 208 is replaced by a static hub fixed to the support 102.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

The invention claimed is:

1. A portable shelter including:

a support including an upright;

a canopy for being supported by the support; and a depth indicator to indicate depth of the support in the ground, the depth indicator being dynamic and expanding with depth;

wherein the canopy includes an expandable frame, and a sheet of material supported by the frame;

wherein the frame includes retractable ribs supporting the sheet, each rib being articulated, pivotally expandable and including:

a proximal member, and a distal member pivotally coupled to the proximal member so that the proximal member and the distal member overlap when the rib is fully expanded;

wherein the frame further includes a stretcher arrangement for stretching out each rib from the support, the stretcher arrangement including:

a first stretcher coupled between the support and one of the ribs; and a second stretcher coupled between the first stretcher and a runner for running along the support.

2. A portable shelter as claimed in claim 1, wherein the sheet of material is supported by the frame at a fixed end and extends from the frame to a fluttering free end opposite the fixed end; the majority of the sheet being unsupported and fluttering in the breeze to provide suitable shade for at least one person.

3. A portable shelter as claimed in claim 1, wherein the sheet of material folds in on itself when the frame is collapsed.

4. A portable shelter as claimed in claim 1, wherein the proximal member is not coupled to an end of the distal member.

5. A portable shelter as claimed in claim 1, wherein an end of the distal member is pivotally coupled to the stretcher arrangement.

6. A portable shelter as claimed in claim 1, wherein the distal member folds up and in toward the proximal member when collapsing the shelter, the frame including two or four ribs.

7. A portable shelter as claimed in claim 1, wherein the stretcher arrangement includes three or more stretchers.

8. A portable shelter as claimed in claim 1, further including at least one stabilizing protrusion for stabilizing the support in the ground, each protrusion being retractable and/or radially extending from the support.

9. A portable shelter as claimed in claim 1, further including: a screw terminating the support for screwing into the ground.

10. A portable shelter as claimed in claim 1, wherein the second stretcher is pivotally and/or slidably coupled to the first stretcher.

11. A portable shelter as claimed in claim 1, further including a third stretcher.

12. A portable shelter as claimed in claim 1, wherein the rib and first stretcher are pivotally mounted at fixed locations to the support.

13. A portable shelter as claimed in claim 1, wherein the support extends from the ground at a single location.

* * * * *